US005189858A

United States Patent [19]

Jouanet

[11] Patent Number: 5,189,858

[45] Date of Patent: Mar. 2, 1993

[54] DECORATIVE PANEL, IN PARTICULAR FOR CEILINGS

[76] Inventor: Daniel Jouanet, 44 rue de Lagny, 75020 Paris, France

[21] Appl. No.: 692,533

[22] Filed: Apr. 29, 1991

[30] Foreign Application Priority Data

Apr. 30, 1990 [FR] France ..... 90 05467

[51] Int. Cl.[5] ..... E04B 9/00

[52] U.S. Cl. ..... 52/488; 52/484; 52/664; 52/665

[58] Field of Search ..... 52/484, 488, 489, 664, 52/665, 666, 667, 668, 669

[56] References Cited

U.S. PATENT DOCUMENTS

| | | | |
|---|---|---|---|
| 1,826,113 | 10/1931 | Hatch . | |
| 4,702,056 | 10/1987 | Carey | 52/488 X |
| 4,720,946 | 1/1988 | Pagliarello | 52/484 X |
| 4,744,194 | 5/1988 | Yasuyoshi | 52/488 X |
| 4,757,663 | 7/1988 | Kuhr | 52/488 X |
| 5,050,360 | 9/1991 | Gailey | 52/488 |

FOREIGN PATENT DOCUMENTS

| | | |
|---|---|---|
| 243227 | 10/1987 | European Pat. Off. . |
| 2659722 | 7/1978 | Fed. Rep. of Germany . |
| 1434025 | 12/1968 | France . |
| 2556760 | 6/1985 | France . |
| 1601074 | 10/1981 | United Kingdom . |

*Primary Examiner*—Richard E. Chilcot, Jr.
*Attorney, Agent, or Firm*—Ostrolenk, Faber, Gerb & Soffen

[57] ABSTRACT

A decorative panel is disclosed, in particular for covering ceilings.

The decorative panel is placed in a rigid rectangular frame formed of four L shaped angle irons, against the outer faces of which shaped sections are fitted, one for each side of the frame, the longitudinal edges of the shaped sections being bent inwardly of the frame, the edges of the decorative panel being held by clamping, substantially over the whole perimeter of the panel, between a flange of the L shaped angle iron and the bent longitudinal edges of the shaped sections.

The shaped sections are fixed on the straight sides of the angle irons by means of a tongue cut out in the shaped section and an indentation formed in the straight side of the angle iron.

8 Claims, 2 Drawing Sheets

FIG. 3
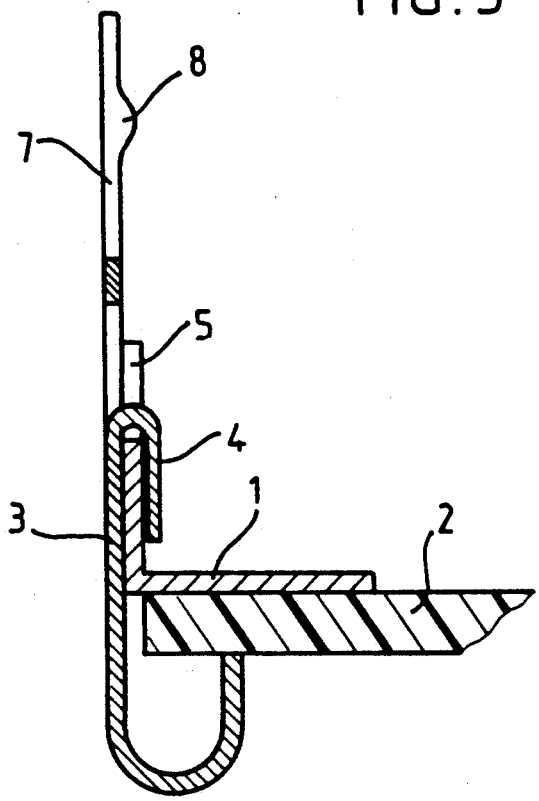
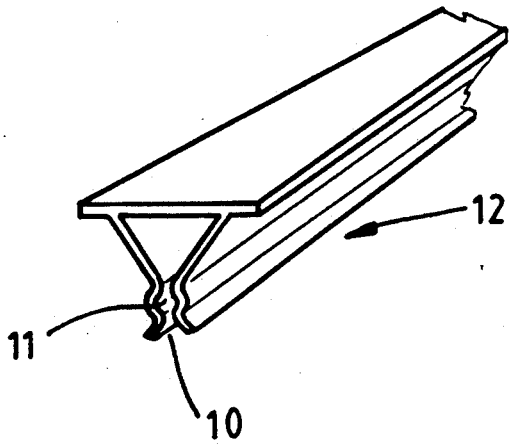
FIG. 4a
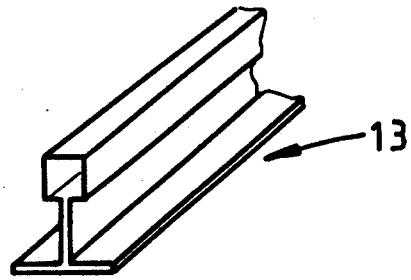
FIG. 4b

DECORATIVE PANEL, IN PARTICULAR FOR CEILINGS

BACKGROUND OF THE INVENTION

The present invention relates to modular panels for covering surfaces, such as ceilings or walls, carried on supports fixed to the ceiling, to the walls or to the framework.

Such decorative or insulating panels, formed of Formica type laminates, metal plates, panels made from compressed fibres and other materials, are usually carried by or fixed to supporting rails or shaped sections.

Although such panels are held in position all along both sides, the fixed support-panel assembly in particular lacks rigidity, especially when the covering panel has a small thickness, for example from about 0.5 to 5 mm. In such cases, the panels warp and contribute to the deterioration of the aesthetic appearance of the assembly and may even lead to separation of the panels.

It is also known to place a decorative covering panel in a frame, the frame itself being formed by four shaped sections assembled at right angles by means of brackets which fit into the ends of the frame sides.

Another drawback met with when fitting panels resides in the fact that the panel must be fitted only after retention means, such as bosses, have been previously fixed for example by clipping into the slot of the support rail.

SUMMARY OF THE INVENTION

The object of the present invention is to avoid such drawbacks by providing a panel which is made absolutely rigid and a component part of which, particularly the frame, has been fitted during construction thereof with retention means. Thus, during fitting of the panel, it is no longer necessary to handle the additional member carrying retention means.

The modular panel for covering surfaces on fixed supports in accordance with the invention is characterized in that it is in the form of a decorative panel placed in a rigid frame, said rectangular frame being formed of four L shaped angle irons, against the outer faces of which shaped sections are fitted, one for each side of the frame, the longitudinal edges of the shaped sections being bent inwardly of the frame, the edges of the decorative panel being held by clamping, substantially over the whole perimeter of the panel, between a flange of the L shaped angle iron and the bent longitudinal edges of the shaped sections. The panel according to the invention can in no case be compared with the panel placed inside a frame formed by the assembly of straight sides by means of brackets fitted into the ends of said sides. In fact, since said brackets only serve as members for assembling the sides of the frame together at right angles, they contribute in no wise to reinforcing the rigidity of the sides of the frame formed often of shaped sections of low mechanical strength nor serve as retention means by clamping the edges of the panels substantially over the whole of their perimeter.

Advantageously, the fixed support carrying the panels will be formed by a T shaped rail having a slot in its central portion. In this case, a longitudinal edge of the shaped section, particularly the one which is opposite the bent edge of this shaped section, will be provided with spaced bosses or a longitudinal rib intended to penetrate into and be retained by the slot of the support.

The support may also be formed by a simple rail having an upturned T profile, on the legs of which will be fitted the edges of the panel made rigid by a frame in accordance with the invention.

The shaped sections at the bent edge, whose length will correspond preferably to the length of the side of the panel, may be mounted and assembled with the outer faces of the angle irons by any known means, such for example as bonding, welding, stapling or similar. Preferably, the assembly will be used by means of a tongue fast with one of the elements which, penetrating inside an indentation formed in the second element, is bent back over this second element.

Advantageously, the tongue is fast with the shaped section and the indentation is formed by cutting out in the material of the angle irons.

The advantage of this method of assembly resides in the fact that the edges of the decorative panel, whose thickness varies for example from 0.5 to 5 mm, can be held clamped by adjusting the bending line of the tongue. In fact, depending on the point along the length of the tongue where it is bent, the gap between the leg of the angle iron and the bent edges of the shaped sections varies in width, whence the possibility of adjusting this width to the thickness of the panel by bending the tongue over a greater or lesser length inside the indentation on the angle iron.

When the panel is fixed by means of retention bosses, with which the upper edge of the shaped section on the fixed support having the slot is provided, the longitudinal edges of the shaped sections are visible from outside and must be lacquered. Preferably, to improve their appearance, these longitudinal edges will be bent in a rounded shape.

The angle irons and the shaped sections are preferably made from galvanized steel or aluminium.

The invention also relates to the rigid rectangular frame for the above described modular panels, which frame is characterized in that it is formed of four L shaped angle irons and four straight shaped sections whose longitudinal edges are bent inwardly of the frame and in that it is provided with means for assembling the angle irons and the shaped sections together.

Preferably, said assembly means consist of indentations and tongues adapted to be bent back inside said indentations.

BRIEF DESCRIPTION OF THE DRAWINGS

Other aspects of the invention will be clear from the following description of one or more embodiments of the invention, illustrated by the accompanying drawings, in which :

FIG. 3 shows in cross section the location of the assembly by means of the tongue and the indentation; and FIGS. 4*a* and 4*b* show two embodiments of the fixed support.

DESCRIPTION OF THE PREFERRED EMBODIMENTS

Figure 1:
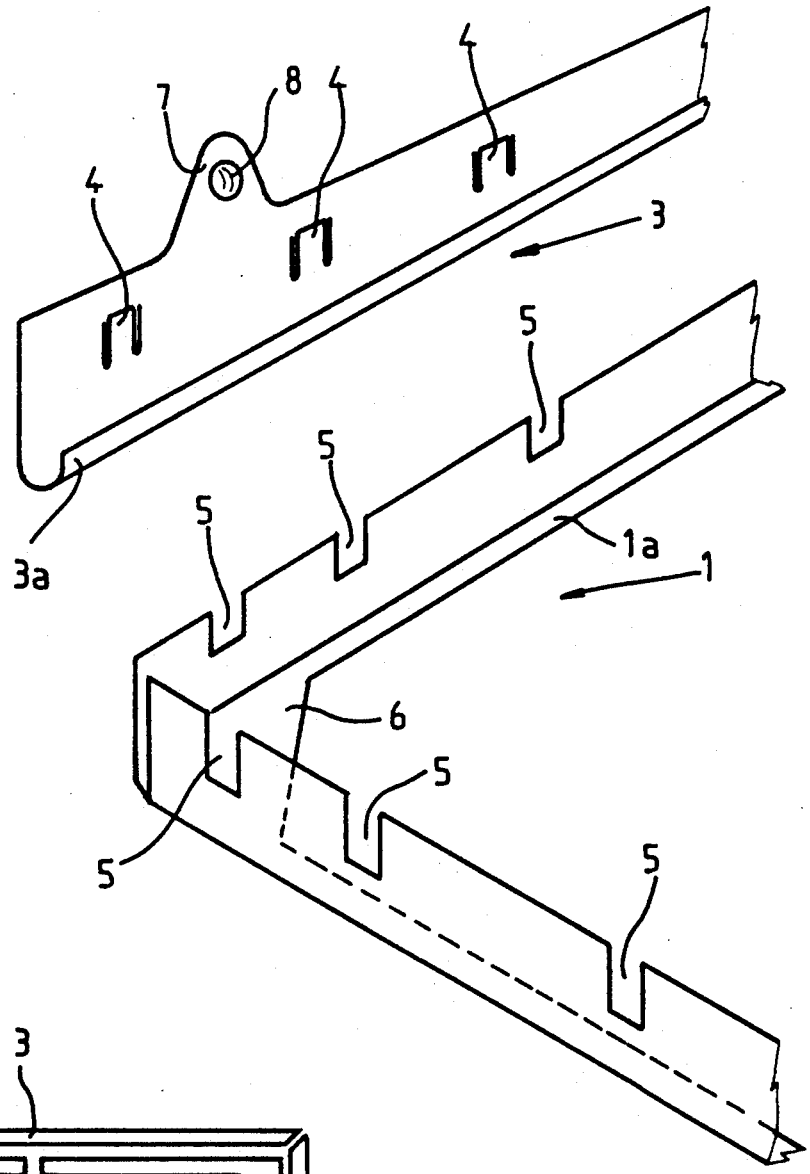
FIG. 1 is a perspective view of the fragments of an angle iron to be assembled with the shaped section which is also shown.
Figure 2:
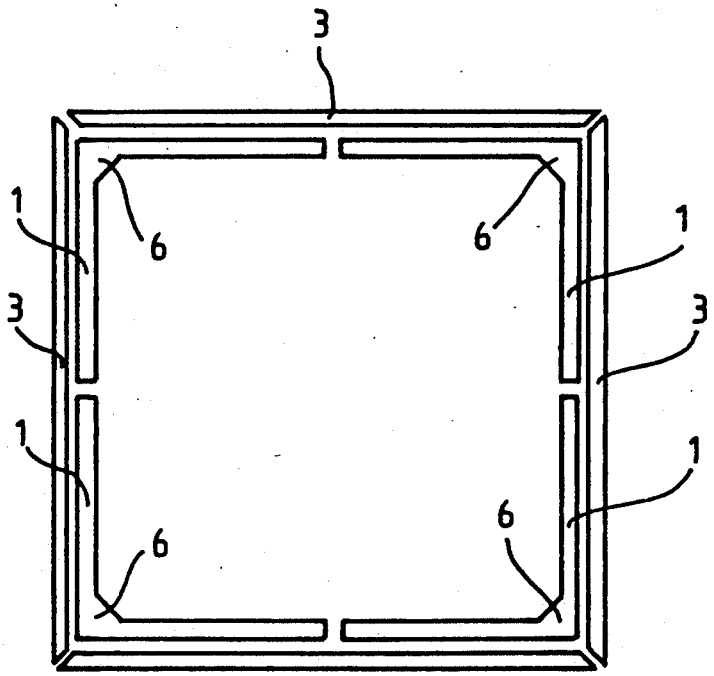
FIG. 2 shows a top view of the framed panel.

The frame is formed of four L shaped angle irons 1 which form a rectangle corresponding to the dimensions of a rectangular laminate panel 2 to be framed.

On each outer side of the rectangle formed by the angle irons 1 is applied a continuous straight section 3 whose lower edge has a bend 3*a* towards the inside of the frame.

The shaped section 3 is assembled on the outer side of the angle irons by means of tongues 4, obtained by cutting the straight portion of the shaped section 3 and indentations 5, through penetration of the tongues into the indentations and bending back over the straight portion of the angle irons. The perfect rigidity of the frame is obtained by the presence of the shaped sections 3 which play the role of fishplates and hold the legs of two adjacent angle irons solidly anchored and by the presence of solid corners 6 reinforcing the cohesion of the legs of each angle iron in the manner of ties.

The manufacture of a modular panel is the following. The decorative laminate panel 2 is assembled by placing its borders on the bent back edges 3*a* of the shaped sections 3. Then, inside the quadrilateral formed by the straight portions of the shaped sections 3, the four angle irons 1 are placed so as to obtain another quadrilateral inside the first one.

Pressure is applied for holding the edges of the panel 2 firmly applied, at the bottom, against the bent edges 3*a* of the shaped sections 3 and, at the top, against the flanges 1*a* of the L shaped angle irons 1. The tongues 4 are bent inwardly of the frame so that they penetrate into the indentations 5, then they are bent over the inner face of the straight portion of the angle irons 1.

The location of the indentations must correspond with great accuracy to that of the tongues.

The lay-out of the tongue and the indentations must allow a certain variation of the gap between the portions clamping the edges of the panels so that, whatever the thickness of the panel, the bending back of the tongue provides a solid assembly of the angle irons and the shaped sections and immobilization of the edges of the panel by clamping.

The modular panel thus produced is intended to be fixed on a fixed support, for example fixed to the ceiling. Such a fixed support may be support 12 shown in FIG. 4*a*. It is a T shaped rail whose lower end has a slot 10 communicating with a sectional swelling 11. When such a support is used, the shaped section 3 must be provided at its upper part with spaced tongues 7 having bosses 8, whose function is to permit suspension of the modular panel on the support by clipping the bosses 8 inside the slots 10, 11 of support 12.

Preferably, each corner of the rectangular panel will be surrounded by two tongues 4 with which the shaped section 3 is provided. To consolidate the rigidity in the region of the corners, each tongue 7 will be provided on each side with a assembly means formed by a bendable tongue 4 and indentation 5. The use of support 12 leaves visible the junction of the two adjacent panels in which the bent edges 3*a* of the shaped sections are adjacent. For aesthetic reasons, the shaped sections will undergo a surface treatment, for example lacquered and the form of the bend 3*a* may be rounded.

Supports 13, such as shown in FIG. 4*b*, may also be used, consisting of an upturned T shaped section. In this case, with the edges of the frames laid on the lateral legs of the upturned T, the shaped sections will not be visible and may not require surface treatment. However, to avoid aesthetic defects, the upturned T section must form a grid over the surface to be covered, so that the four sides of the panel are laid and so hidden from sight.

The modular panel of the invention provides excellent rigidity for the covering formed by such a panel.

It has the further great advantage of being able to be manufactured on automatic large scale production machines, contrary to known panels, whose assembly with members for fixing the panel to the fixed support requires the use of a bonding agent or welding.

Another important advantage resides in the fact that the panel formed in accordance with the invention no longer requires a complementary member for fitting it or fixing it to a fixed structural support. In fact, the frame incorporated in the modular panel at the time of its manufacture already comprises means for fitting it or fixing it to fixed supports.

The invention is not limited to the embodiments described above, it is susceptible of numerous variants within the scope of a man skilled in the art.

Thus, although the legs 1 of the angle iron preferably extend over the whole perimeter of the rectangular frame which they form, they may also be placed with spacing between their ends, depending on the desired degree of rigidity of the frame, particularly depending on the mechanical strength of the straight shaped sections 3.

What is claimed is:

1. A modular panel for covering surfaces on a fixed support, comprising:

a rigid frame formed by four L-shaped angle irons, each having an outer surface and a flange;

a decorative panel having an edged perimeter held by said rigid frame; and a shaped section fitted against the outer surface of each of said four L-shaped angle irons, each shaped section having a longitudinal end bent inwardly of the frame, wherein the edges of the decorative panel are clamped, substantially over the entire perimeter, between the flange of each of said L-shaped angle irons and the bent longitudinal edges of each of said shaped sections.

2. The modular panel as claimed in claim 1, wherein the fixed support includes a longitudinal slot and each of the shaped sections is provided with spaced bosses or a longitudinal rib located opposite the bent edge, said spaced bosses or longitudinal rib being adapted to penetrate into and be retained by the slot in the support.

3. The modular panel as claimed in claim 1, wherein each of said shaped sections include a plurality of tongues and each of said angle irons includes a plurality of corresponding indentations, wherein the shaped sections are fixed to the outer surface of said angle irons by extending the tongues into the indentations and bending the tongues over the angle irons.

4. The modular panel as claimed in claim 3, wherein the tongues are integral with the shaped section and the indentations are formed by cutting out and removing material from the angle irons.

5. The modular panel as claimed in claim 3, wherein each of the plurality of tongues is capable of being bent at various points along its length to clamp the edges of a variety of decorative panels having different thicknesses.

6. The modular panel as claimed in claim 1, wherein the longitudinal edges of the shaped sections are bent in a rounded shape.

7. The modular panel as claimed in claim 1, wherein the angle irons and the shaped sections are made from galvanized steel or aluminium.

8. The modular panel claimed in claim 1, further comprising means for assembling the angle irons and the shaped sections together.

* * * * *